US006499956B2

(12) United States Patent
Nakamura

(10) Patent No.: US 6,499,956 B2
(45) Date of Patent: Dec. 31, 2002

(54) RESONATOR-INTEGRATED FAN SHROUD AND RESONATOR-INTEGRATED FAN SHROUD WITH AIR INTAKE DUCT

(75) Inventor: Kentaro Nakamura, Aichi (JP)

(73) Assignee: Inoac Corporation, Aichi (JP)

( * ) Notice: Subject to any disclaimer, the term of this patent is extended or adjusted under 35 U.S.C. 154(b) by 0 days.

(21) Appl. No.: 09/781,269

(22) Filed: Feb. 13, 2001

(65) Prior Publication Data

US 2001/0018022 A1 Aug. 30, 2001

(30) Foreign Application Priority Data

Feb. 25, 2000 (JP) ..... 2000-050278
Apr. 28, 2000 (JP) ..... 2000-130953

(51) Int. Cl.[7] ..... F04D 29/38

(52) U.S. Cl. ..... 416/189; 415/119; 416/169 A; 181/224

(58) Field of Search ..... 416/189, 169 A; 415/119, 228, 220, 915; 181/224, 225, 250

(56) References Cited

U.S. PATENT DOCUMENTS 4,116,269 A * 9/1978 Ikeda ..... 165/135
4,596,921 A * 6/1986 Hersh et al. ..... 219/370
4,774,030 A * 9/1988 Kinkel et al. ..... 261/29
5,192,464 A * 3/1993 Pawlowski et al. ..... 261/27
5,333,576 A 8/1994 Verkleeren
5,423,658 A * 6/1995 Pla et al. ..... 415/118
5,649,587 A 7/1997 Plant ..... 165/41
5,971,062 A * 10/1999 Sadr et al. ..... 165/104.32

FOREIGN PATENT DOCUMENTS

EP 0 371 341 A1 6/1990
EP 0 995 895 A2 4/2000

* cited by examiner

*Primary Examiner*—Edward K. Look
*Assistant Examiner*—James M McAleeenan
(74) *Attorney, Agent, or Firm*—Sughrue Mion, PLLC

(57) ABSTRACT

A hollow vessel (1) which is partitioned into one or a plurality of hollow chambers (S) by blow molding is used as a resonator (2), and the hollow vessel (1) is arranged to form a fan shroud body (3), and that a drain hole (13) is formed in a bottom portion and/or a lower side portion of the hollow vessel (1), and a communicating pipe (4) fitted to the hollow vessel (1) and an air intake duct (5) connected to the communicating pipe (4) are formed integrally with the hollow vessel (1).

12 Claims, 12 Drawing Sheets

RESONATOR-INTEGRATED FAN SHROUD AND RESONATOR-INTEGRATED FAN SHROUD WITH AIR INTAKE DUCT

BACKGROUND OF THE INVENTION

1. Field of the Invention

The present invention relates to a resonator-integrated fan shroud and a resonator-integrated fan shroud with an air intake duct, each of which is installed in an engine compartment of a vehicle.

2. Description of the Related Art

Recently, a demand for reducing noise of an automobile to a low level has heightened year by year, and has become particularly stringent concerning an intake system of an engine 77 (FIGS. 14 to 17). A resonator 80, a side branch, or the like has hitherto been used as a means for reducing the noise from the intake system. Recently, however, in conjunction with a reduction in the number of component parts and a tendency toward a smaller space, the capacity of a muffler such as the resonator 80 has tended to become small or to be disused. Further, development of a substitute item such as a tuning hole for a high-frequency band (100 Hz or higher) is under way. In FIGS. 14 to 17, reference numeral 70 denotes a fan; reference numerals 71 and 72 denote air intake ducts; reference numeral 73 denotes an air cleaner; reference numeral 74 denotes an air intake duct (air cleaner hose); reference numeral 75 denotes an intake connector; reference numeral 76 denotes an intake manifold; reference numeral 78 denotes a radiator; and reference numeral 79 denotes a fan shroud.

For example, U.S. Pat. No. 5,649,587 discloses automotive radiator fan shrouds and, more particularly to such shrouds which are blow molded to include hollow compartments which serve as reservoirs for fluids, such as coolant fluid, and/or window and headlamp washer fluids, including air and other gasses.

However, the situation is such that if an attempt is made to reduce the noise in the low-frequency band (100 Hz or lower), the large-capacity resonator must be still used. The reason for this is that the increase in the capacity lowers the frequency to be attenuated, and the amount of attenuation can be made large.

Due to its large capacity, the low-frequency resonator 80 could be conventionally installed in a very limited specific position inside the engine compartment. In addition, since there is a limitation and the like in the installation of the equipment, there has been a problem in that the intake passages 71, 72, and 74 become long. Further, with the conventional resonator 80 made by injection molding or the like, only two hollow chambers (chambers having two kinds of resonance frequencies) at most could be formed. Additionally, since the resonator 80 is fabricated separately, the cost tended to be high.

SUMMARY OF THE INVENTION

The invention overcomes the above-described problems, and an object of the invention is to provide a resonator-integrated fan shroud and a resonator-integrated fan shroud with an air intake duct which make it possible to install a resonator without taking up much space and without making the intake passages long.

To attain the above object, there is provided a resonator-integrated fan shroud characterized in that a hollow vessel which is partitioned into one or a plurality of hollow chambers is used as a resonator, and the hollow vessel is arranged to form a fan shroud body.

The resonator-integrated fan shroud is characterized in that a communicating pipe to be connected to an air intake duct is formed integrally with the hollow vessel.

The resonator-integrated fan shroud is characterized in that a drain hole is formed in a bottom portion of the hollow vessel.

There is provided a resonator-integrated fan shroud with an air intake duct, characterized in that a hollow vessel which is partitioned into one or a plurality of hollow chambers by blow molding is used as a resonator, and the hollow vessel is arranged to form a fan shroud body, and that a drain hole is formed in a bottom portion of the hollow vessel, and a communicating pipe fitted to the hollow vessel and an air intake duct connected to the communicating pipe are formed integrally with the hollow vessel.

If the hollow vessel is used as the resonator, and the hollow vessel is arranged to form the fan shroud body, practically no space is required for installing the resonator in addition to the fan shroud.

If the communicating pipe and the air intake duct are integrally formed by blow molding or the like, the number of component parts is reduced, leading to a reduction in the cost.

If a drain hole is formed, it is possible to easily drain water and the like which entered the air intake duct and condensed.

There is provided a resonator-integrated fan shroud comprising a fan shroud body and a cover member formed in the shape of a vessel and having one side formed as an opening, wherein a hollow box whose interior is hollow is formed as the cover member is joined to and integrated with the fan shroud body in a state in which the opening of the cover member is oriented toward a wall surface of the fan shroud body, and the hollow box is used as a resonator.

The resonator-integrated fan shroud is characterized in that a communicating pipe to be connected to an air intake duct is formed integrally with the hollow vessel.

If the hollow box whose interior is hollow is formed as the cover member is joined to and integrated with the fan shroud body in a state in which the opening of the cover member is oriented toward the wall surface of the fan shroud body, and this hollow box is used as a resonator, practically no space is required for installing the resonator in addition to the fan shroud.

If the communicating pipe is integrally formed, the number of component parts is reduced, leading to a reduction in the cost.

DETAILED DESCRIPTION OF THE PRESENT INVENTION

Figure 1:
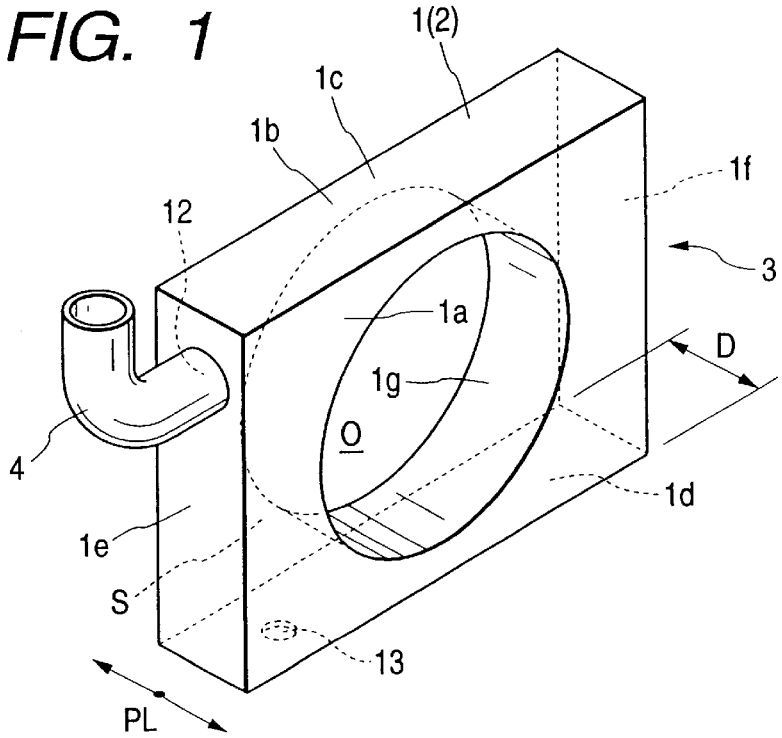
FIG. 1 is a perspective view of a first embodiment of a resonator-integrated fan shroud in accordance with the invention.

Hereafter, the present invention will be described for a resonator-integrated fan shroud and a resonator-integrated fan shroud with an air intake duct with reference to the accompanying drawings.

FIRST EMBODIMENT

FIGS. 1 to 5 are perspective views illustrating resonator-integrated fan shrouds according to a first embodiment of the present invention.

This resonator-integrated fan shroud is a hollow vessel 1 fabricated by blow molding, the fan shroud which is conventionally plate-shaped is formed in the shape of a hollow box, and this hollow vessel 1 is used as a resonator 2.

First, a description will be given of the resonator-integrated fan shroud of FIG. 1 according to the present invention. A fan shroud body 3 concerning the fan shroud is fabricated by blow molding, and the hollow vessel 1 having a hollow interior is formed at this time. A hollow chamber S is formed by resin-made plate portions (a front plate portion 1*a*, a rear plate portion 1*b*, an upper plate portion 1*c*, a bottom plate portion 1*d*, left and right side plate portions 1*e* and 1*f*, and a cylindrical plate portion 1*g* in FIG. 1) with a predetermined thickness t (see FIG. 9), which are obtained by blow molding by blowing air in a state in which a parison is clamped in a mold. The hollow chamber S having a space in its interior is formed by making the depth D (D>>t) of the fan shroud body 3 larger than the plate thickness of the conventional plate-shaped fan shroud. Although the hollow vessel 1 may be formed by ordinary blow molding, the hollow vessel 1 is formed by deep-drawing blow molding in a case where the depth D is large. As for the fan shroud body 3, even if the depth D is made somewhat large, no problem is generally presented, and in many cases there is a space-wise leeway inside a narrow engine compartment. This hollow chamber S is used as a resonance box of the resonator 2.

A drain hole 13 is appropriately formed in the bottom plate portion 1*d*, as necessary. The drain hole 13 can be formed by post-processing, or may be also formed as a blow hole during molding. By providing the drain hole 13, water which entered the interior of the resonator 2, i.e., the hollow vessel 1, through an air intake duct 5 and condensed water can be smoothly drained outside the resonator.

Figure 14:
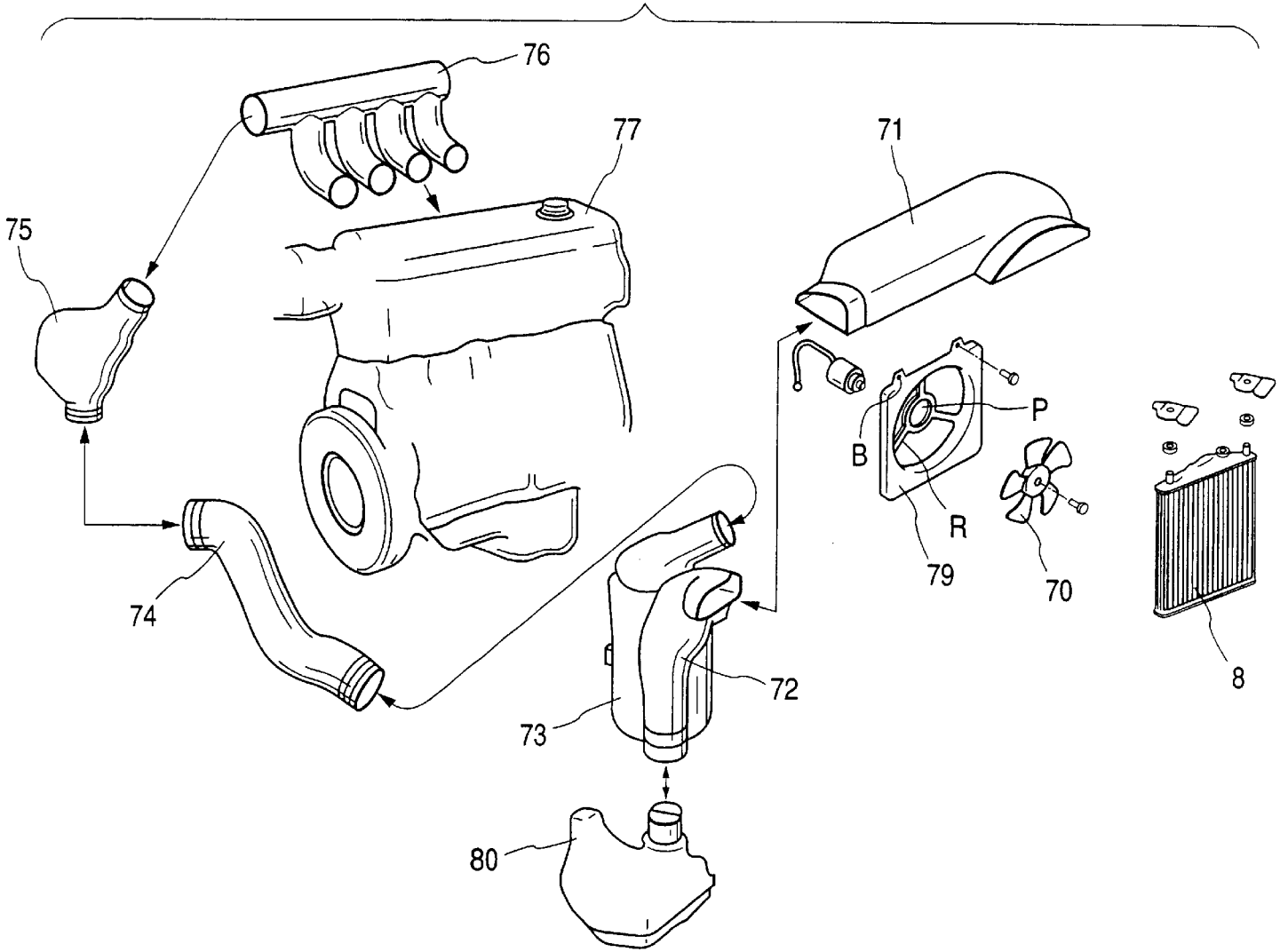
FIG. 14 is an exploded perspective view explaining the conventional art.

Meanwhile, the hollow vessel 1 has a shape in which the outer shape is cubic and a large circular hole O is formed in the center, as shown. By making use of this circular hole O, a cooling fan of a radiator can be attached to the hollow vessel 1, and the hollow vessel 1 makes up the fan shroud body 3. Namely, the hollow vessel 1 is adapted to be used jointly as a protector which is the fan shroud installed around the cooling fan of the radiator. The shroud body 3 is appropriately provided with screw holes B for attaching this fan shroud to an unillustrated mating member, a fan attaching guide hole P, ribs R for improving the efficiency of the fan, guides, and the like (see FIG. 14).

In the fan shroud body 3 shown in FIG. 1, a hollow cylindrical communicating pipe 4 is attached to a position close to an upper end of the side plate portion 1*e* by one-piece molding during blow molding. The communicating pipe 4 in this case has a shape in which it is bent in an L-shape. To obtain necessary performance and the like, the communicating pipe 4 can be molded as a separate piece, and can be assembled in post-processing. Reference numeral 12 denotes a hole for a communicating hole formed in the side plate portion 1*e* corresponding to a proximal end portion of the communicating pipe 4. Reference characters PL denote a parting line in blow molding.

Figure 2:
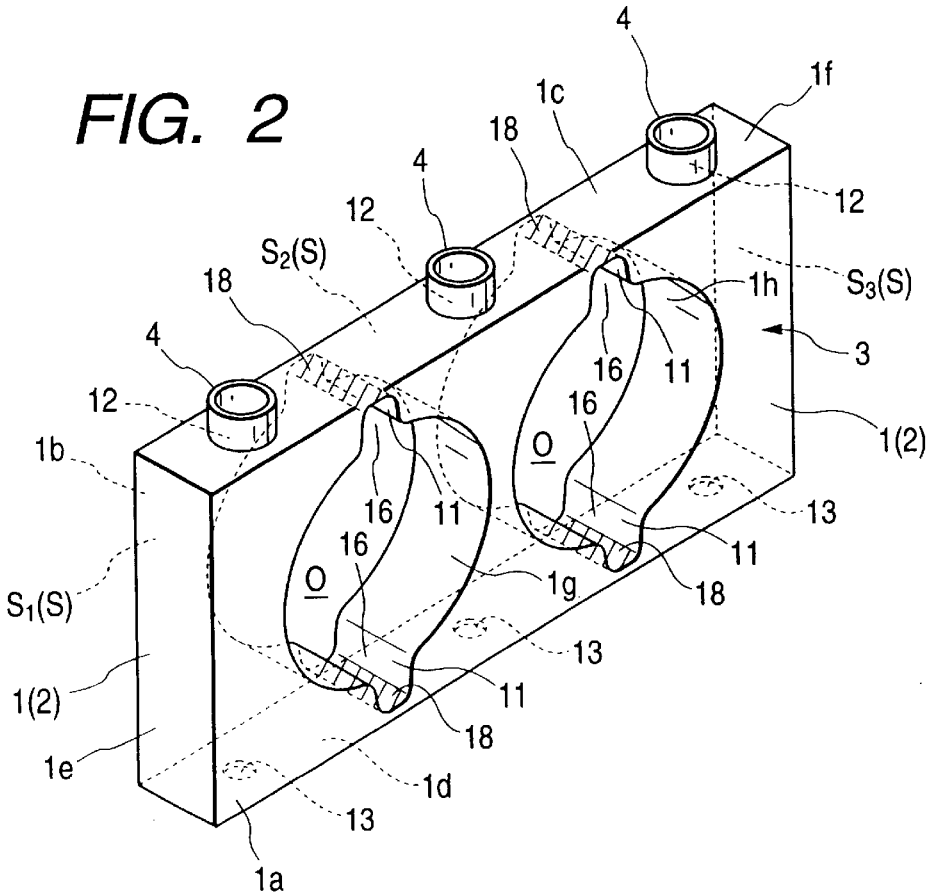
FIG. 2 is a perspective view of the resonator-integrated fan shroud in accordance with a variation of the first embodiment, in which two circular holes are provided.

The resonator-integrated fan shroud may be formed in a shape such as the one shown in FIG. 2. FIG. 2 is a perspective view of the resonator-integrated fan shroud according to one variation of the first embodiment in which the resonator-integrated fan shroud shown in FIG. 1 is modified. This resonator-integrated fan shroud is provided with two large circular holes O in which fans for cooling the radiator are accommodated.

When the fan shroud body 3 concerning the fan shroud is fabricated by blow molding, the plate portions (the front plate portion 1*a*, the rear plate portion 1*b*, the upper plate portion 1*c*, the bottom plate portion 1*d*, the left and right side plate portions 1*e* and 1*f*, and the cylindrical plate portions 1*g* and 1*h*) with the predetermined thickness t (see FIG. 9) are formed from the parison so as to form the hollow vessel 1. Further, during the blow molding of the hollow vessel 1 (it is, of course, possible to employ a method using vibrational welding, thermal fusion, or the like in post-processing), upper and lower central portions of the parisons of the hollow cylindrical plate portions 1*g* and 1*h* are pushed and pressed while forming partition walls 11, and are fused to parison portions opposing thereto. Crushed portions 18 which have been fused and joined are located at two portions in upper and lower positions (four portions in total) of each of the two hollow cylindrical plate portions 1*g* and 1*h*. The fan shroud body 3 is divided into three partitioned hollow chambers $S_1$, $S_2$, and $S_3$ by the formation of the partition walls 11 and the crushed portions 18. It should be noted that, in FIG. 2 (similarly in FIGS. 6 and 8), the crushed portions 18 are illustrated by hatching to facilitate an understanding.

The communicating pipes 4 are respectively attached to positions on the upper plate portion 1*c* corresponding to the three hollow chambers $S_1$, $S_2$, and $S_3$ by one-piece molding with the fan shroud body 3. The holes 12 are necessarily formed at the joints between the hollow chambers $S_1$, $S_2$, and $S_3$ and the communicating pipes 4 by blow molding, allowing the hollow chambers S and the communicating pipes 4 to communicate with each other. The hollow chambers S in FIG. 2 respectively serve as resonance boxes for the resonator 2. If the capacities of the three hollow chambers $S_1$, $S_2$, and $S_3$ are made different, the hollow vessel 1 (resonator 2) having three resonance frequencies can be formed.

Meanwhile, the shape of the hollow vessel 1 is such as to form the fan shroud body 3 which makes it possible to incorporate two fans, thereby forming the resonator-integrated fan shroud.

Figure 3:
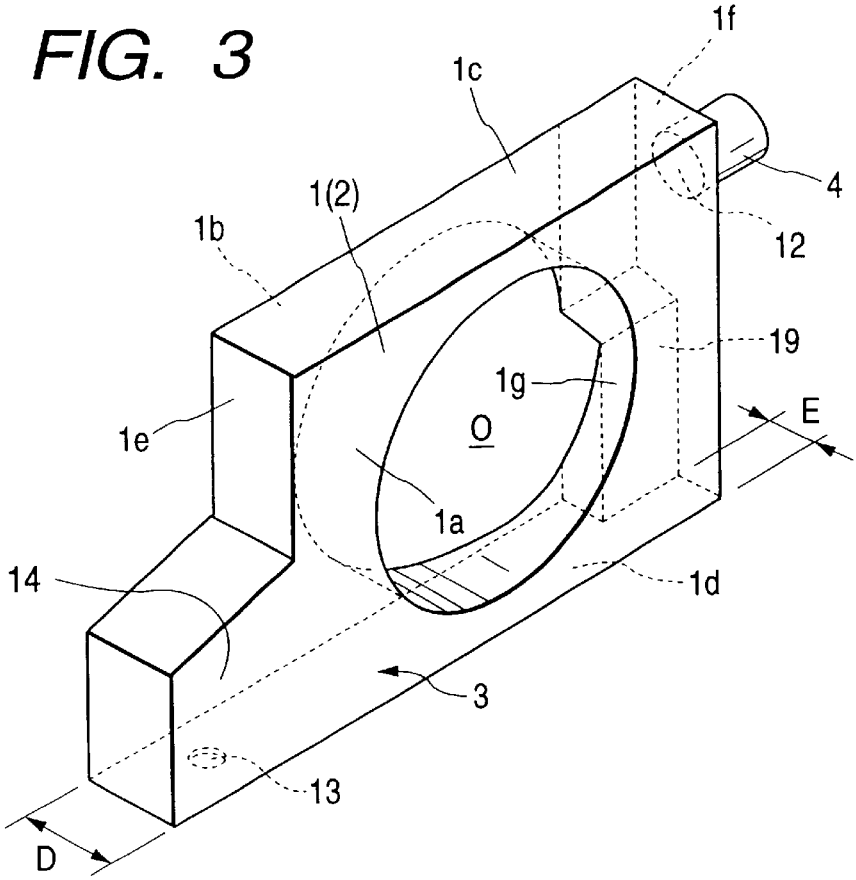
FIG. 3 is a perspective view of the resonator-integrated fan shroud in accordance with another variation of the first embodiment.

In addition, the resonator-integrated fan shroud may be also formed as the hollow vessel 1 having a hollow interior, as shown in FIG. 3. FIG. 3 is a perspective view of the resonator-integrated fan shroud according to another variation of the first embodiment in which the resonator-integrated fan shroud shown in FIG. 1 is modified.

Necessary equipment and the like are installed around the fan shroud, and there are cases where there is a portion 19 where the depth D of the fan shroud body 3 cannot be made large. This resonator-integrated fan shroud is designed to cope with such a case, and the depth E is made small where the necessary equipment and the like are present, while the depth of the remaining portion is set as the depth D (D>E). Further, in a case where it is impossible to obtain a resonator capacity commensurate with the frequency to be attenuated, the hollow vessel 1 is jutted out in a direction in which space can be secured, e.g., in a lateral direction, so as to secure a necessary capacity 14, thereby reducing the noise. If an empty space is available around the fan shroud, the shape of the hollow vessel 1 is deformed to make effective use of the empty space. The communicating pipe 4 is formed by a short pipe, and is provided on the right side plate portion if in FIG. 3. The other arrangements are similar to those of the resonator-integrated fan shroud shown in FIG. 1, and a description thereof will be omitted. The same reference numerals as those in FIG. 1 denote identical portions or corresponding portions.

Figure 4:
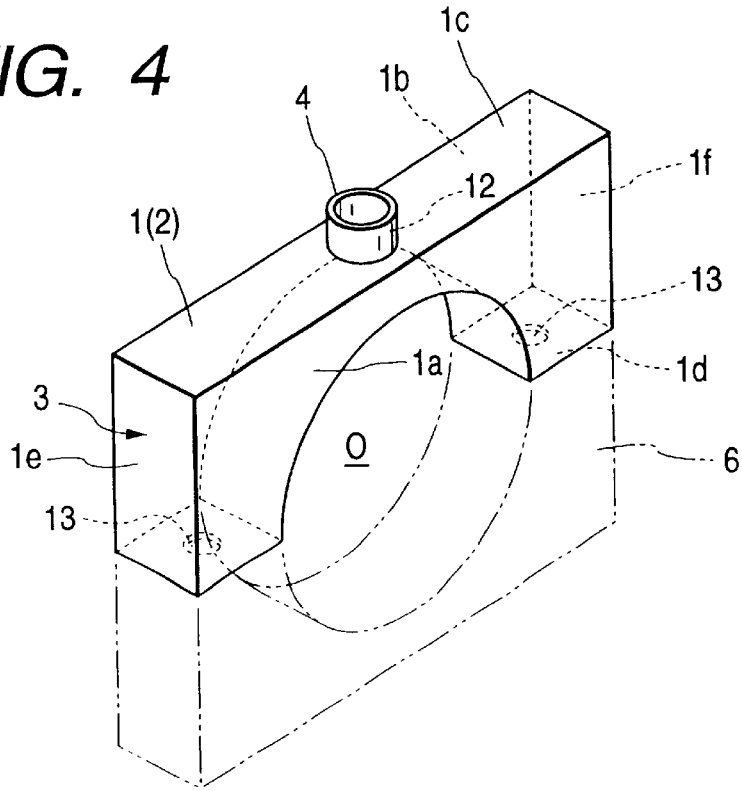
FIG. 4 is a perspective view of the resonator-integrated fan shroud in accordance with a still another variation of the first embodiment.

In addition, the resonator-integrated fan shroud may be formed in a shape such as the one shown in FIG. 3. FIG. 4 is a perspective view of the resonator-integrated fan shroud in which an upper half portion of the fan shroud is formed as the hollow vessel 1 so as to be used jointly as the resonator 2. A lower half 6 of the fan shroud is formed as a separate piece, the hollow vessel 1 formed by blow molding is used as the resonator 2, and the hollow vessel 1 is made to carry the shroud body 3 of the upper half of the fan shroud.

Figure 5:
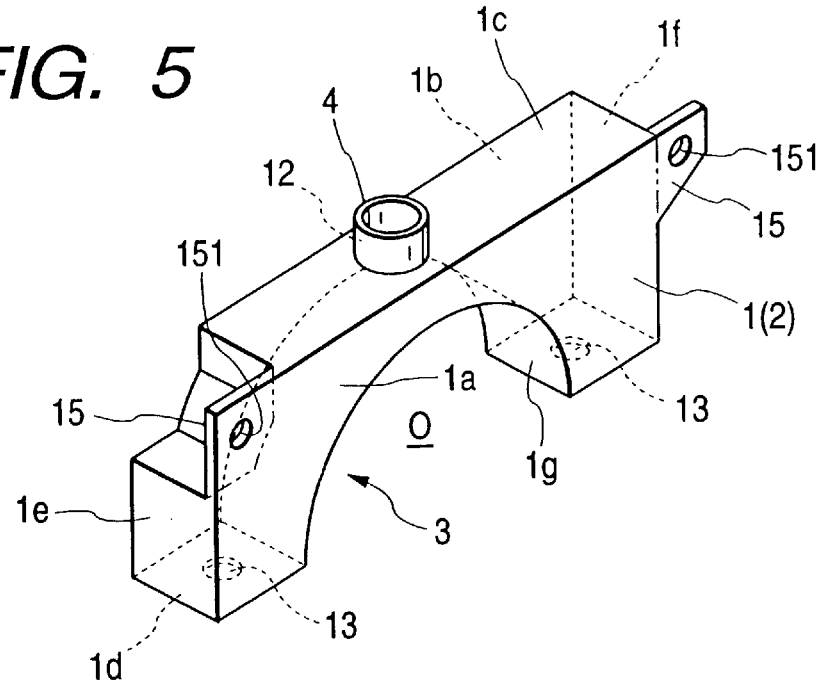
FIG. 5 is a perspective view of the resonator-integrated fan shroud in accordance with a still another variation of the first embodiment.

FIG. 5 shows a resonator-integrated fan shroud in which the resonator-integrated fan shroud shown in FIG. 4 is further developed, and during the blow molding of the hollow vessel 1, both upper corner ends of parison are crushed to integrally form attaching portions 15. Reference numeral 151 denotes a hole for attaching the fan shroud to a mating member. The other arrangements of the resonator-integrated fan shroud in FIGS. 4 and 5 are similar to those of the resonator-integrated fan shroud shown in FIG. 1, and a description thereof will be omitted. The same reference numerals as those in FIG. 1 denote identical portions or corresponding portions.

SECOND EMBODIMENT

FIGS. 6 to 9 are perspective views illustrating resonator-integrated fan shrouds each with an air intake duct according to a second embodiment of the invention.

This resonator-integrated fan shroud with an air intake duct is one in which the air intake duct 5 is further integrated with the resonator-integrated fan shroud, such as the one shown in one of FIGS. 1 to 5, by blow molding.

Figure 6:
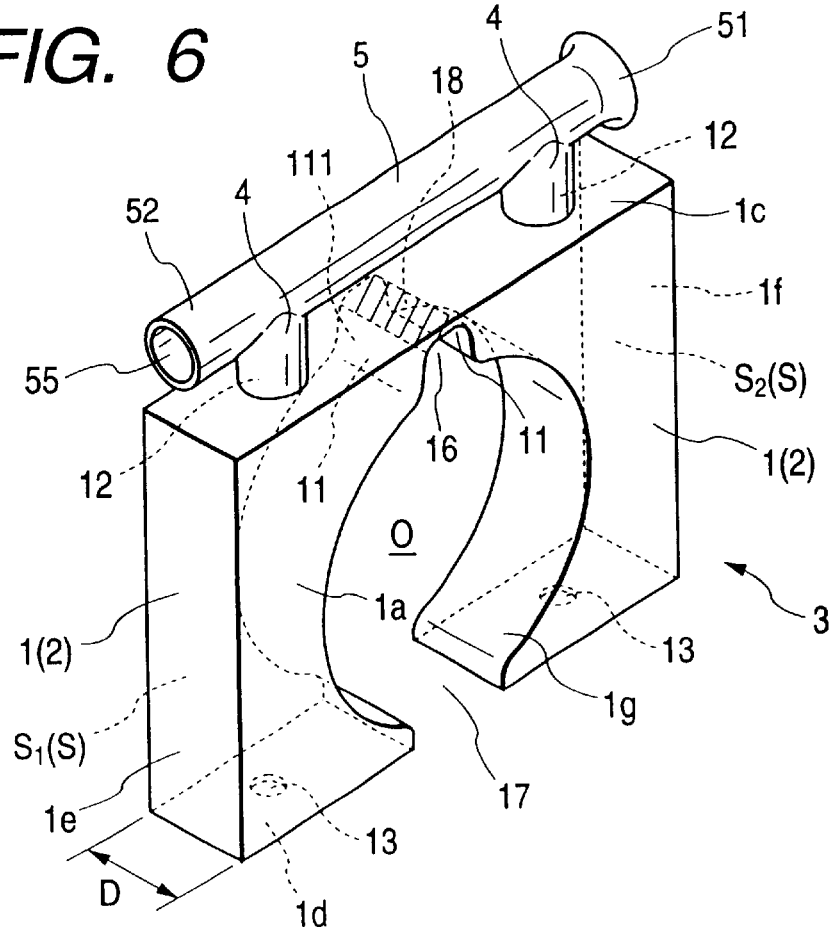
FIG. 6 is a perspective view of a second embodiment of a resonator-integrated fan shroud with an air intake duct in accordance with the invention.

For example, the resonator-integrated fan shroud with an air intake duct may be formed as shown in FIG. 6. In FIG. 6, the hollow vessel 1 which is partitioned and formed into two hollow chambers S by blow molding is made to function as the resonator 2, and the hollow vessel 1 is made to carry the shroud body 3. Then, the communicating pipe 4 is attached to the hollow vessel 1, and the air intake duct 5 is connected to the communicating pipe 4 by one-piece molding.

The hollow vessel 1 has a lower center cut out to form a passage 17 for the circular hole O. During the blow molding of the hollow vessel 1, an upper central portion of the parison of the hollow cylindrical plate portion 1*g* is pushed while forming the partition wall 11, and is fused to a parison portion opposing thereto, thereby forming the crushed portion 18 at the same time. The fan shroud body 3 is divided into two partitioned hollow chambers $S_1$ and $S_2$ by the formation of the partition wall 11 and the crushed portion 18. The communicating pipes 4 communicating with the respective hollow chambers S are provided on the upper plate portion 1*c* by one-piece molding, and the other end portions of the communicating pipes 4 are set in a state of being joined to the air intake duct 5. The air intake duct 5 shown in FIG. 6 is arranged parallel to the upper plate portion 1*c*, and its right end is formed as an intake port 51, while its left end is formed as an air-cleaner-side connecting port 52. The rectilinear air intake duct 5 having an air passage 55 formed therein is made to communicate with the hollow vessel 1 through each communicating pipe 4.

Figure 7:
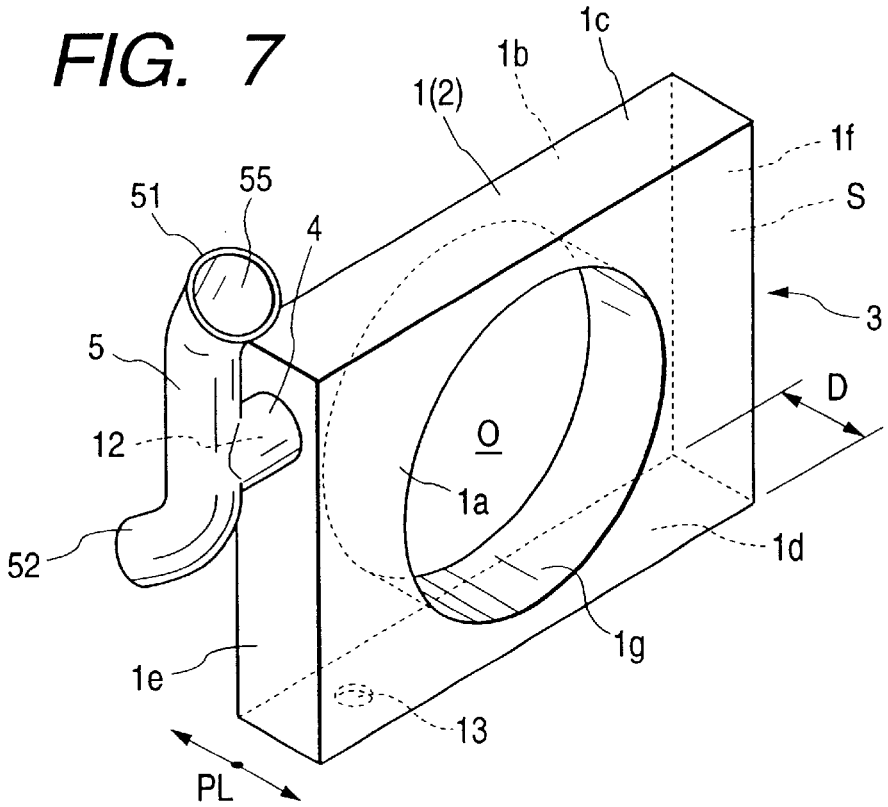
FIG. 7 is a perspective view of the resonator-integrated fan shroud with an air intake duct in accordance with a variation of the second embodiment.

As shown in FIG. 7, in the resonator-integrated fan shroud with an air intake duct, the air intake duct 5 may be also formed integrally with the communicating pipe 4 of the resonator-integrated fan shroud shown in FIG. 1. The communicating pipe 4 shown in FIG. 7 is a straight short pipe different from the one shown in FIG. 1, but the other portion s (those of the resonator-integrated fan shroud) are similar to those shown in FIG. 1, so that a description thereof will be omitted. The air intake duct 5 with the air passage 55 formed therein has a form in which it extends along the left side plate portion 1*e* shown in FIG. 7, and its upper end is formed as the intake port 51, while its lower end is formed as the air-cleaner-side connecting port 52.

Figure 8:
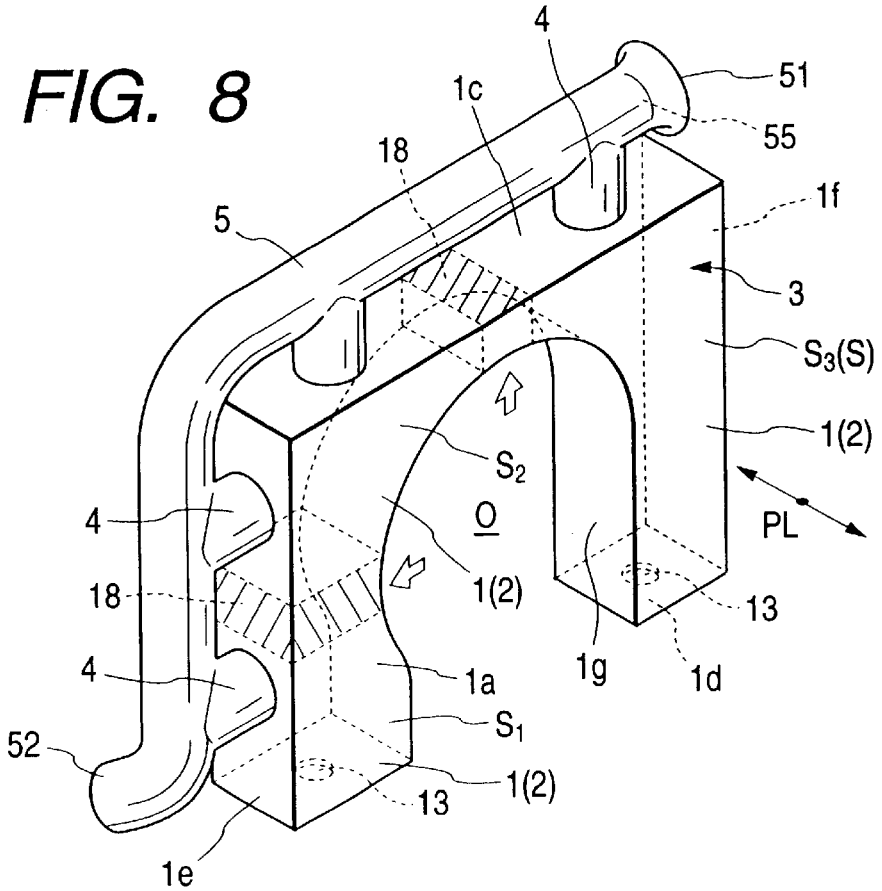
FIG. 8 is a perspective view of the resonator-integrated fan shroud with an air intake duct in accordance with another variation of the second embodiment.

In addition, the resonator-integrated fan shroud with an air intake duct may be formed as shown in FIG. 8. This resonator-integrated fan shroud with an air intake duct is formed as the hollow vessel 1 having the shape of a box whose lower side is cut away in an inverse U-shape, and four communicating pipes 4 are formed integrally at predetermined intervals on the upper plate portion 1*c* and the left side plate portion 1*e* shown in FIG. 8. Further, the air intake duct 5 which extends along the upper plate portion 1*c* and the left side plate portion 1*e* shown in FIG. 8 is formed integrally with the hollow vessel 1 and the communicating pipes 4. This resonator-integrated fan shroud with an air intake duct is formed by blow molding as the resonator 2 (shroud body 3) having a single hollow chamber S as shown by the solid lines in FIG. 8. Subsequently, thermal fusion tools or the like are pressed in the directions of unfilled arrows in the drawing in post-processing so as to form the crushed portions 18 in the same way as in FIG. 1, thereby partitioning the inner chamber into the three chambers $S_1$, $S_2$, and $S_3$. One communicating pipe 4 is made to communicate with each of the hollow chambers $S_1$ and $S_3$, and two communicating pipes 4 are made to communicate with the hollow chamber $S_2$.

Figure 9:
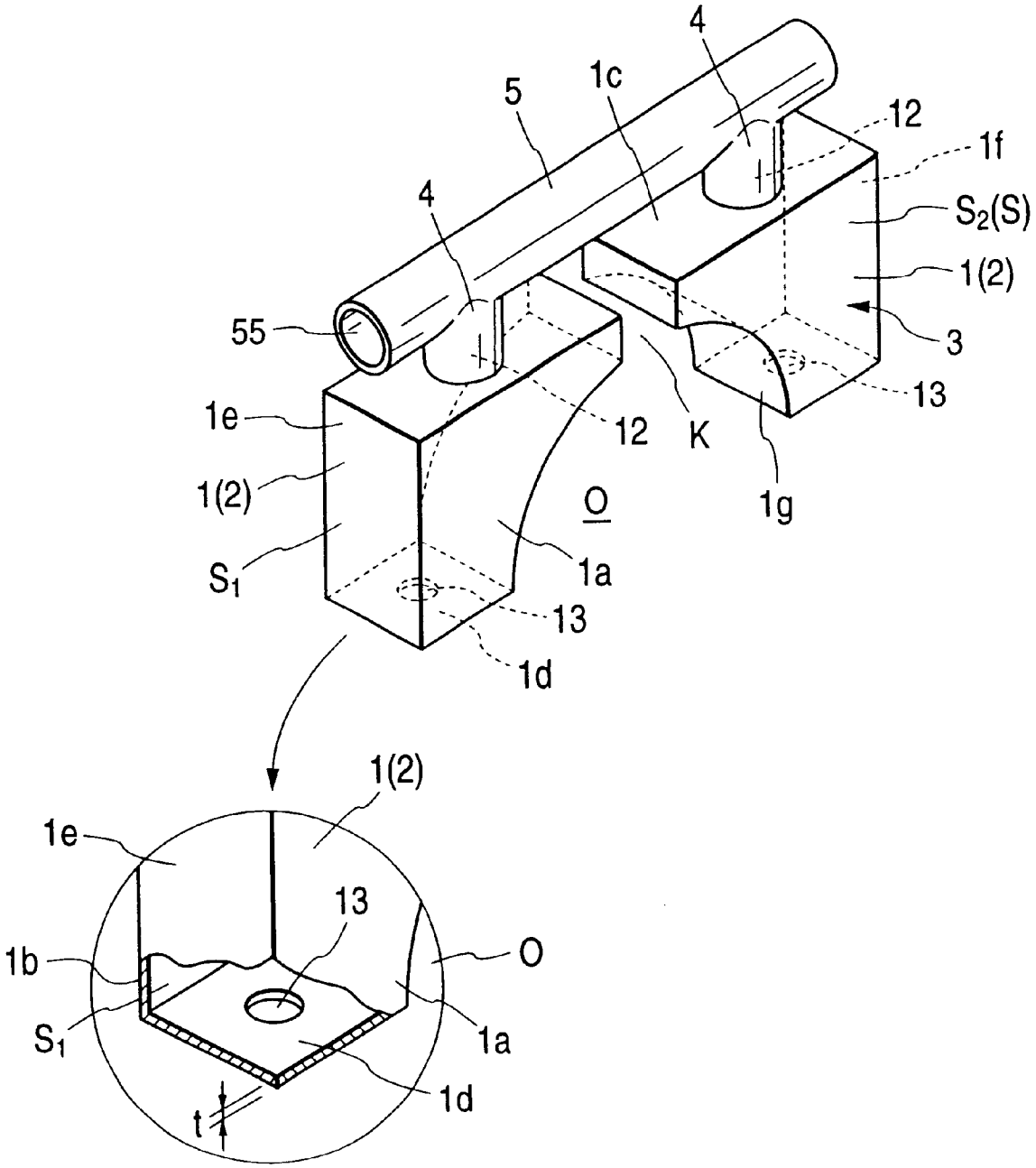
FIG. 9 is a perspective view of the resonator-integrated fan shroud with an air intake duct in accordance with a still another variation of the second embodiment.

In addition, the resonator-integrated fan shroud with an air intake duct may be formed as shown in FIG. 9. In this resonator-integrated fan shroud with an air intake duct, the air intake duct 5 is attached by one-piece molding to a modified article of the resonator-integrated fan shroud shown in FIG. 4. The upper half of the hollow vessel 1 making up the shroud body 3 is fabricated by blow molding, but at that tie the upper half of the hollow vessel 1 is further split into two parts of left and right sides. Reference character K denotes a split interval between the left and right hollow vessels 1.

The hollow vessel 1 having a hollow interior S is fabricated by plate portions with the predetermined thickness t corresponding to the thickness of a parison. If the size of the two hollow vessels 1 is varied, it is possible to obtain the resonator 2 capable of attenuating different frequencies. Further, the communicating pipe 4 is formed integrally on the upper plate portion 1*c* with respect to the left and right hollow vessels 1, and the other end of the communicating pipe 4 is integrally joined to the air intake duct 5. The air intake duct 5 is disposed in parallel to the upper plate portion 1*c*. Since the other arrangements are substantially similar to those of FIG. 4, a description thereof will be omitted.

With the resonator-integrated fan shroud and the resonator-integrated fan shroud with an air intake duct thus constructed, the fan shroud body 3 which is conventionally formed in a plate shape is formed as the hollow vessel 1, and is jointly-used as the resonator 2 for the air intake duct 5, and this arrangement is extremely effective in view of the present situation where it is difficult to secure the space for the resonator 2 in the engine compartment for which stepped-up efforts are being made for making the space compact. The resonator 2 having a large capacity can be obtained in the limited space, and the silencing effect becomes large. The resonator-integrated fan shroud and the resonator-integrated fan shroud with an air intake duct in accordance with the invention demonstrate power in the reduction of noise in a low-frequency band which can be solved only by the inevitable use of the large-capacity resonator 2.

Since the fan shroud body 3 normally becomes large as compared with the resonator capacity, if the hollow chamber S is partitioned and formed into two or more chambers, it is possible to reduce the noise in mutually different low-frequency bands by varying the capacities of the hollow chambers, and it is possible to further enhance its effect. It becomes possible to provide tuning corresponding to various frequency bands depending on the method of fitting between the hollow vessel 1 and the air intake duct 5 and by such as the adjustment of the capacity of the hollow vessel 1, i.e., the resonator 2. Tuning is possible not only for the low-frequency bands but also for high-frequency bands.

Further, since the air intake duct 5 is essentially disposed close to the fan shroud, the air intake passage is favorably prevented from becoming long.

In addition, since the shroud body 3 is fabricated by the blow-molded hollow vessel 1, and is jointly used as the resonator 2, the manufacturing cost becomes lower than the resonator 2 which is conventionally fabricated as a separate piece. The communicating pipe 4 and the air intake duct 5 (primary-side air intake) can be integrally molded with the hollow vessel 1, and, when so done, the manufacturing cost can be further lowered. The number of components decreases, and inventory control is facilitated.

It should be noted that the invention is not limited to the ones shown in the foregoing first and second embodiments, and various modifications are possible within the scope of the invention depending on the object and applications. The shapes, sizes, the number, the material, and the like of the hollow vessel 1, the communicating pipe 4, the air intake duct 5, and the like may be appropriately selected in accordance with the application. Although in the first and second embodiments a description has been given of only the hollow chamber S which is partitioned and formed into one to three chambers, it goes without saying that the hollow vessel 1 partitioned and formed into a greater number of chambers may be used as the resonator 2, and the hollow vessel 1 may be formed as the shroud body 3. Although the hollow vessels 1 shown in FIGS. 1 to 9 have shapes in which the fan attaching hole or holes O are open in a cubic body, their shapes are not limited to the same. In addition, although the resonator-integrated fan shroud and the resonator-integrated fan shroud with an air intake duct in accordance with the embodiments are fabricated by blow molding, the invention is not limited to the same, and they may be fabricated by assembling component parts fabricated by, for instance, injection molding or the like.

THIRD EMBODIMENT

Figure 10:
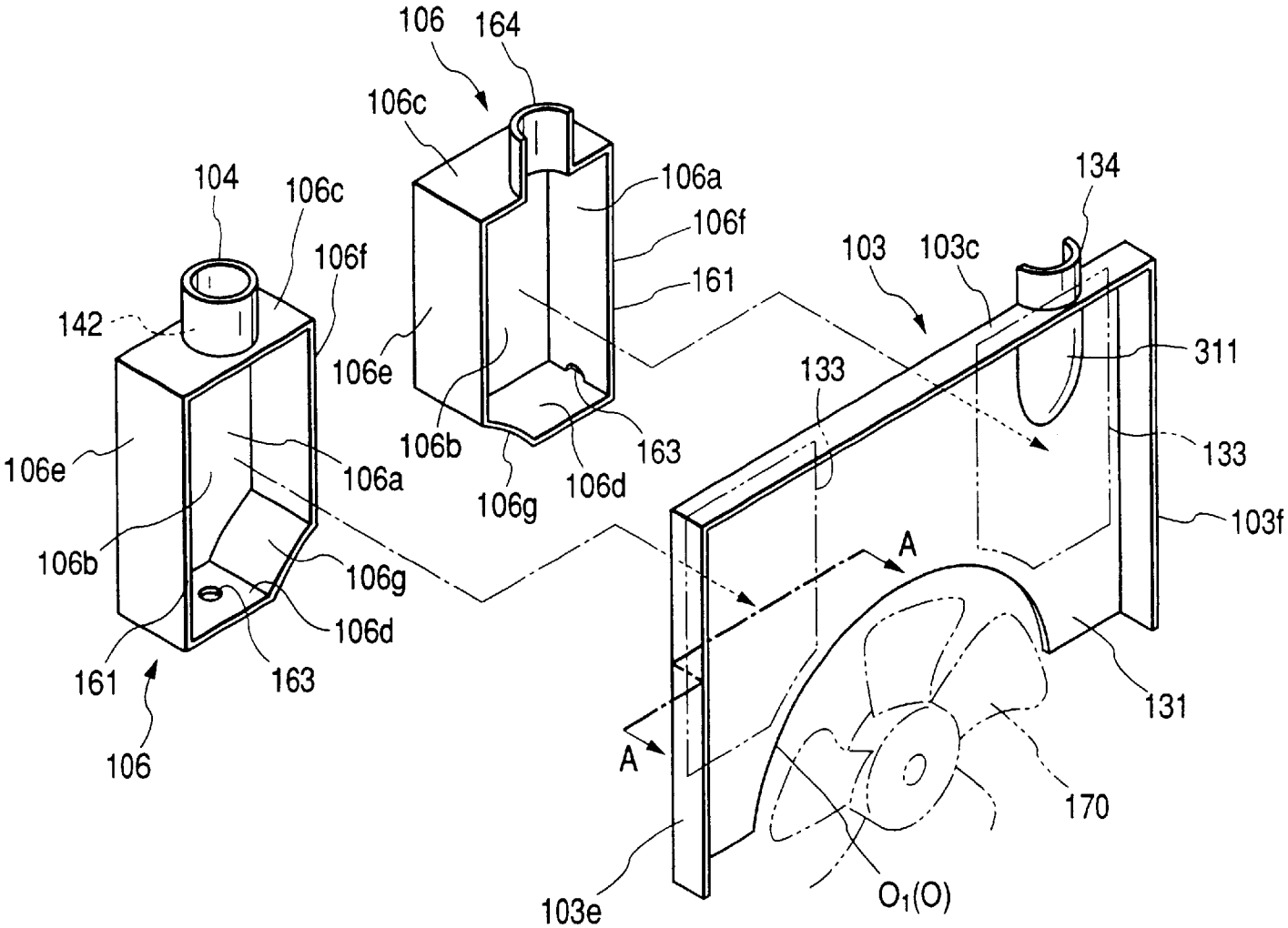
FIG. 10 is an exploded perspective view of a third embodiment of a resonator-integrated fan shroud in accordance with the invention.
Figure 11:
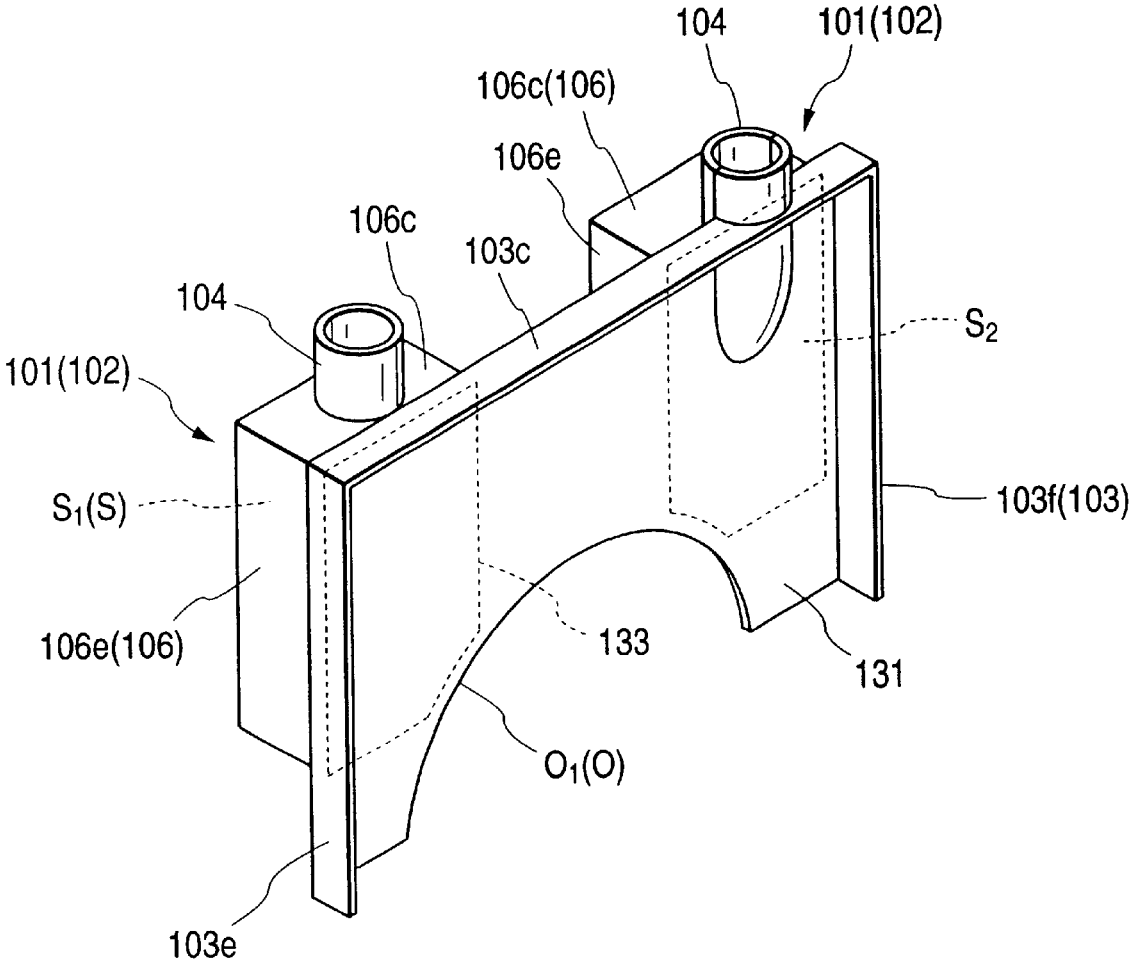
FIG. 11 is a perspective view in which the resonator-integrated fan shroud shown in FIG. 10 is completed.
Figure 12A:
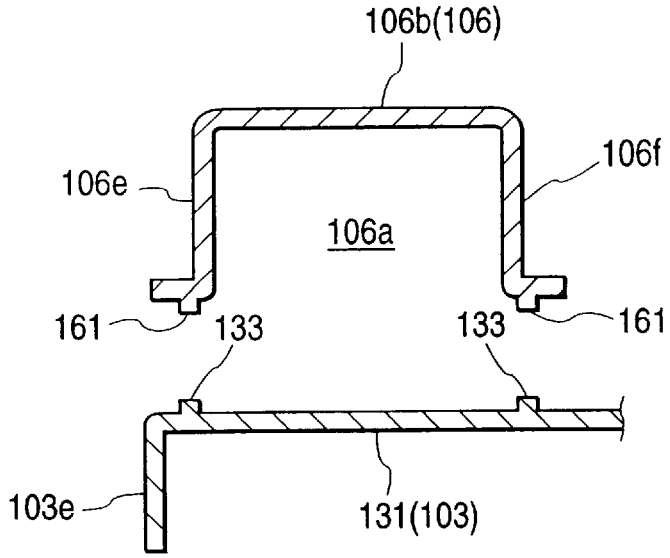
FIG. 12A is a cross-sectional view prior to joining a cover member to a fan shroud body.
Figure 12B:
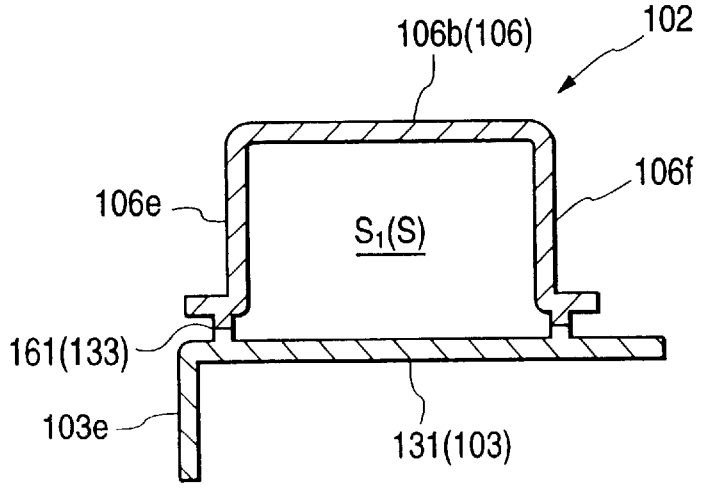
FIG. 12B is a cross-sectional view of a state in which the cover member is joined to the fan shroud body.
Figure 13:
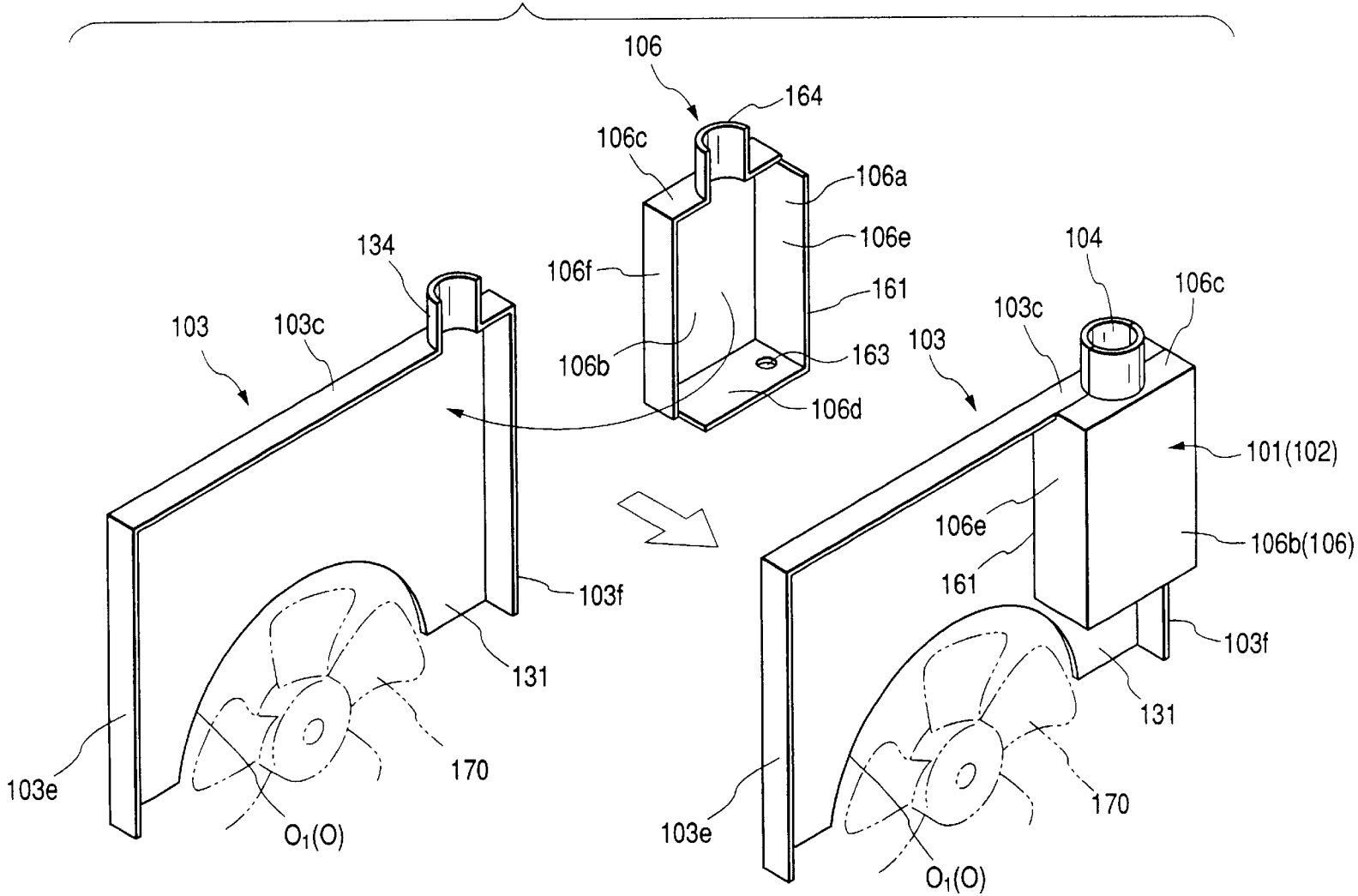
FIG. 13 is a perspective view of the resonator-integrated fan shroud in accordance with a variation of the third embodiment.

FIGS. 10 to 13 are diagrams illustrating a resonator-integrated fan shroud according to a third embodiment of the invention. FIG. 10 is an exploded perspective view thereof, FIG. 11 is an overall perspective view thereof, FIG. 12 is a cross-sectional view of a state in which a fan shroud body and a cover member are joined and fixed, and FIG. 13 is a perspective view of the resonator-integrated fan shroud according to a variation of the third embodiment.

In this resonator-integrated fan shroud, a pair of cover members 106 each formed in the shape of a vessel and having one side formed as an opening 106*a* are fitted to a side wall of a fan shroud body 103 fabricated by injection molding, blow molding, or the like, and the respective members are integrated and formed into hollow shapes. Then, these hollow boxes 101 are used as a resonator 102. This resonator-integrated fan shroud is provided with two hollow chambers $S_1$, and $S_2$.

The resonator-integrated fan shroud has the fan shroud body 103 and the cover members 106.

The fan shroud body 103 is a surrounding plate installed around a cooling fan of a radiator. Here, the fan shroud body 103 is a frame member forming an upper half portion of the fan shroud, and has a base plate 131, left and right plate portions 103*e* and 103*f*, and an upper plate portion 103*c*, as shown in FIG. 10.

The base plate 131 is a plate-shaped member whose lower edge is cut away in a semicircular shape, and a relatively wide and smooth surface is secured for it. An upper half portion of a fan 170 is disposed in this cut-away semicircular hole $O_1$. The plate-shaped left and right plate portions 103*e* and 103*f* and upper plate portion 103*c* of predetermined widths are formed by being bent orthogonally with respect to the base plate 131 at left and right side edges and an upper edge portion of the base plate 131 so as to protect the fan 170 and secure mechanical strength. The shroud body 103 is appropriately provided with screw holes B for attaching the fan shroud body 103 to an unillustrated mating member, a fan attaching guide hole P, ribs R for improving the efficiency of the fan, guides, and the like (see FIG. 14).

A half-split tubular portion 134 is formed uprightly at a position close to the right-hand side on the upper plate portion 103*c* of the fan shroud body 103 shown in FIG. 10. A base plate portion 311 contiguous to proximal edges of the half-split tubular portion 134 is curved such that this side thereof in the drawing becomes convex in such a manner as to surround the half-split tubular portion 134. The cover members 106 are respectively fitted to a rear surface of the base plate at two positions and are joined thereto. However, as shown in FIG. 12, a protrusion 133 where a portion corresponding to the peripheral edge of the opening of each cover member 106 is built up by a predetermined height is formed. The two hollow boxes 101 are formed by respectively joining and fixing the cover members 106 to the two protrusions 133 by welding or the like.

It should be noted that, in the third embodiment, the rear surface of the base plate (or the rear surface of the fan shroud body 103) refers to the rear surface of the base plate 31 (the fan shroud body 103) with respect to a radiator 178. An unillustrated radiator is disposed on the lower left-hand side of FIGS. 10 and 13, and the surface of the base plate 131 opposing thereto is a front surface of the base plate 131, and the opposite surface is the rear surface of the base plate. Similarly, the surface of the fan shroud body 103 opposing the radiator is its front surface, and the opposite surface is its rear surface.

The cover member 106 is a vessel-shaped member having one side formed as the opening 106*a*. In the third embodiment, two cover members 106 are used in FIG. 10, and each cover member 106 forms a box-shaped vessel whose one side is formed as the opening 106*a* by means of a rear plate portion 106*b* at an innermost position in the drawing, an upper plate portion 106*c*, a bottom plate portion 106*d*, a left plate portion 106*e*, a right plate portion 106*f*, and a slanting plate portion 106*g*. The cover member 106 has its surface on this side in the drawing open.

Figure 15:
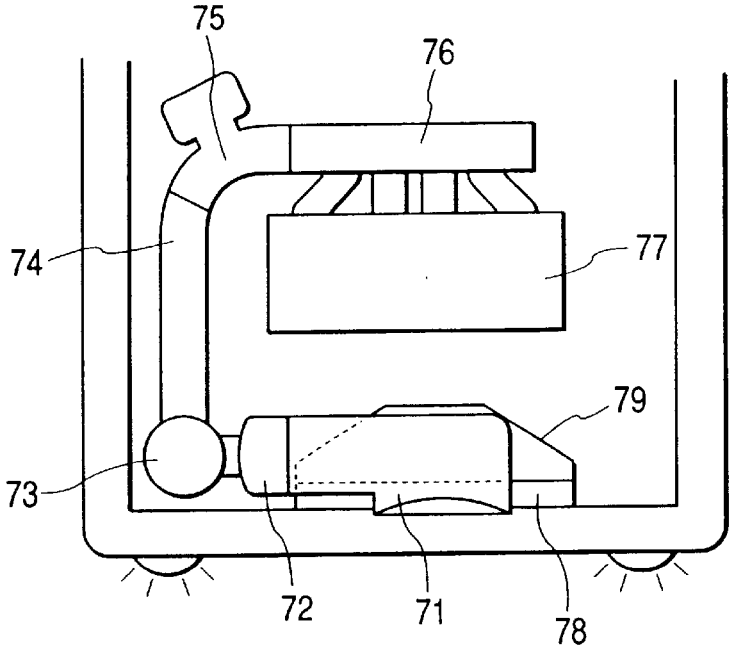
FIG. 15 is a plan view explaining FIG. 14.
Figure 16:
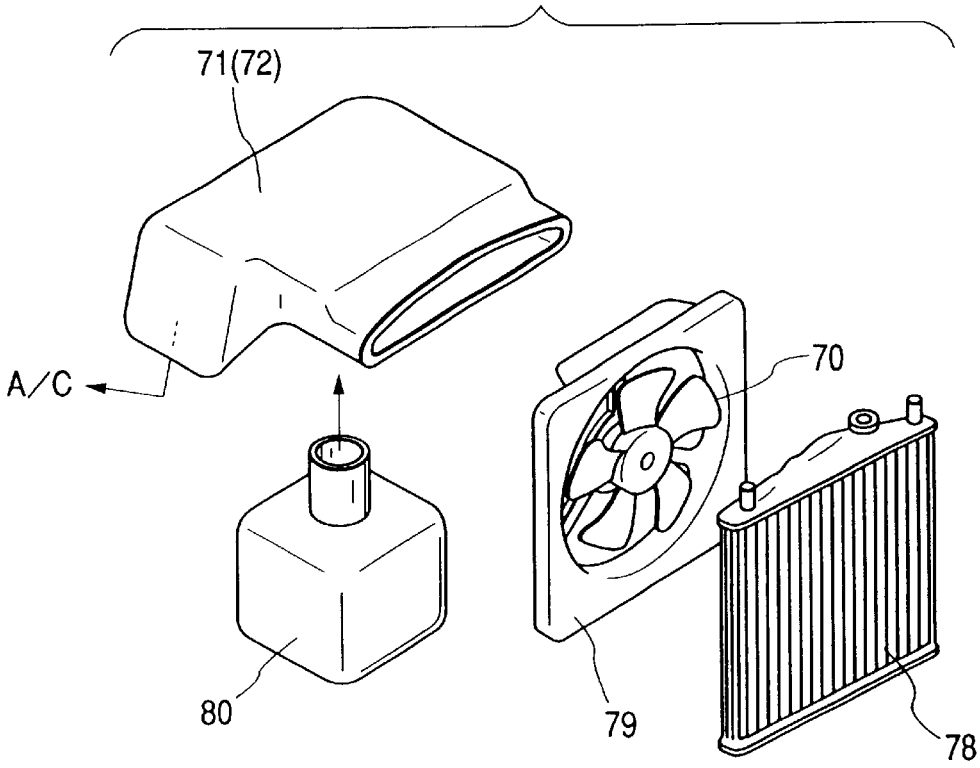
FIG. 16 is a perspective view explaining the conventional art.
Figure 17:
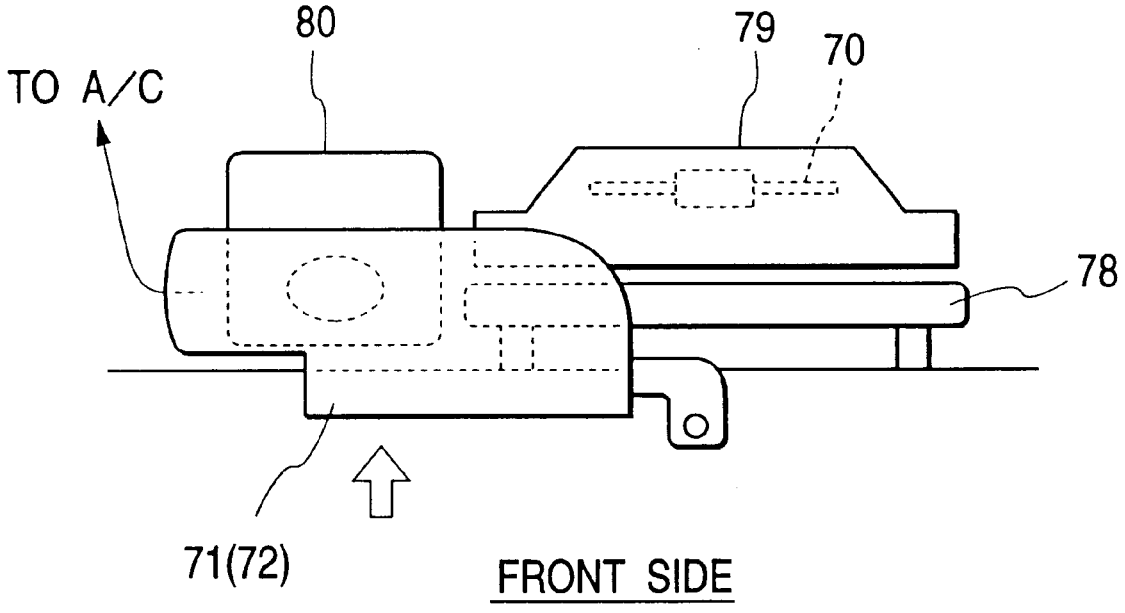
FIG. 17 is a plan view explaining FIG. 16.

A half-split tubular portion 164 is provided on the upper plate portion 106*c* of the right-hand cover member 106 at a position corresponding to the aforementioned half-split tubular portion 134 in a mutually opposing manner. If the half-split tubular portion 164 is joined to and integrated with the half-split tubular portion 134 so as to be combined in a state in which the opening 106*a* of the right-hand cover member 106 is oriented toward the wall surface of the base plate, the half-split tubular portions 164 and 134 form a hollow cylindrical portion, and at the same time the hollow box 101 with its interior formed as a hollow S is formed by the cover member 106 and the fan shroud body 103 (FIG. 11). This hollow box 101 can be used as a resonance box of the resonator 102, and the hollow cylindrical portion serves as a communicating tube 104 allowing an unillustrated air intake duct and the hollow box 101 to communicate with each other. On the upper plate portion 106*c* of the left-hand cover member 106 shown in FIG. 15, a communicating tube 104 formed of a hollow cylindrical short pipe communicating with the interior of the vessel is integrally formed with the cover member 106 from the outset. As for the left-hand cover member 106 as well, if it is joined to and integrated with the fan shroud body 103 in a state in which its opening 106*a* is oriented toward a predetermined wall surface of the base plate 131, the hollow box 101 with its interior formed as the hollow S is formed by the cover member 106 and the fan shroud body 103.

A joining portion 161 at a peripheral edge of the opening of the cover body 106 for being joined and fixed to the fan shroud body 103 is slightly protruded, as shown in FIG. 12, thereby facilitating the joining operation such as welding or the like. As the joining portion 161 at the peripheral edge of the opening 106*a* of the cover member 106 and the protruded portion 133 are made to abut against each other, thereby positively sealing the opening 106*a*. It should be noted that, in FIG. 10, the opening 106*a* and its surrounding portions are illustrated in a simplified form, and a detailed illustration of the joining portion 161 is omitted.

A drain hole is appropriately formed in the bottom plate portion 106*d*, as necessary. The drain hole can be formed in post-processing, or may be also formed as a blow hole during molding. By providing the drain hole 163, water which entered the interior of the resonator 102, i.e., the hollow vessel 101, through an air intake duct and condensed water can be smoothly drained outside the system.

In the resonator-integrated fan shroud in accordance with the invention, the fan shroud body 103 and the cover members 106 are molded in advance as separate pieces, and the respective members are joined and integrated later. An empty space can be secured around the fan shroud even in a narrow engine compartment. Accordingly, the hollow boxes 101 for the resonators are formed so as to allow the fan shroud body 103 to form portions of the resonators 102. Effective use is made of the vacant space on the rear surface side of the base plate of the fan shroud body 103, and the base plate 131 is made to play a partial role of forming the resonator 102, thereby making maximum use of the space and effecting a reduction in the cost.

In addition, with this resonator-integrated fan shroud, the hollow box 101 may be formed either on the rear surface or the front surface of the base plate 131, and may be formed as shown in FIG. 13, for example. Although, in FIGS. 10 to 12, the cover members 106 are joined to and integrated with the rear surface of the fan shroud body 103 (base plate 131) to form the hollow boxes 101, the hollow box 101 in this case is provided on the front surface of the base plate 31, as shown in FIG. 13. Not only the base plate 131 of the fan shroud body 103 but also the upper plate portion 103*c* and the right plate portion 103*f* also constitute portions of the hollow box 101.

In the same way as in FIG. 10, the cover member 106 forms a box-shaped vessel whose one side is formed as the opening 106*a* in which this side thereof in the drawing is open by means of the rear plate portion 106*b* at an innermost position in the drawing, the upper plate portion 106*c*, the bottom plate portion 106*d*, and the left and right plate portions 106*e* and 106*f* (FIG. 13). However, widths of the upper plate portion 106*c* and the right plate portion 106*f* (the left plate portion in the exploded perspective view in FIG. 13) are smaller than widths of the bottom plate portion 106*d* and the left plate portion 106e (the right plate portion in the exploded perspective view in FIG. 13) so that the hollow box 101 can be formed by being joined and fixed to an upper right corner of the fan shroud body 103. When joining is effected with the opening 6*a* of the cover member 106 oriented toward the wall surface of the base plate 131 of the fan shroud body 103, the peripheral edge of the opening 106*a* of the cover member 106 can be brought into contact with the base plate 131, and the peripheral edge of the opening of the cover member can be made to abut against side edges of the upper plate portion 103*c* and the right plate portion 103*f*.

When the cover member 106 and the fan shroud body 103 are joined and integrated, the hollow box 101 serving as the resonator 102 is formed, and at the same time the half-split tubular portion 164 fixed uprightly on the upper plate portion 106*c* of the cover member 106 forms a hollow cylinder in cooperation with the half-split tubular portion 134 fixed uprightly on the upper plate portion 103*c* of the fan shroud body 103, thereby forming the communicating pipe 104. An open end of the communicating pipe 104 is connected to an unillustrated air intake duct, and the communicating pipe 104 allows the air intake duct and the resonator 102 to communicate with each other. It should be noted that, in FIG. 13, the protruded joining portion 161 and the protrusion 133 such as those shown in FIG. 12 are not provided. The other arrangements are similar to those of the resonator-integrated fan shroud shown in FIGS. 10 to 12, so that a description thereof will be omitted.

With the resonator-integrated fan shroud thus constructed, since a portion of the fan shroud body 103 is jointly used as it is as a portion of the hollow box 101 so as to form the resonator 102 for the air intake duct, it is possible to make use of a narrow vacant space around the fan shroud body 103. This arrangement is extremely effective in view of the present situation where it is difficult to secure the space for the resonator 102 in the engine compartment for which stepped-up efforts are being made for making the space compact. By making use of the base plate 131 of the fan shroud body 103 which occupies a relatively large area, it is possible to fabricate the resonator 102 having a large capacity, and the silencing effect becomes large. The resonator-integrated fan shroud in accordance with the invention demonstrates power in the reduction of noise in a low-frequency band which can be solved only by the inevitable use of the large-capacity resonator 102. If the hollow chamber S is partitioned and formed into two or more chambers, it is possible to reduce the noise in mutually different low-frequency bands by varying the capacities of the hollow chambers S, and it is possible to further enhance its effect. It becomes possible to provide tuning corresponding to various frequency bands by such as the adjustment of the capacity of the hollow vessel 101, i.e., the resonator 102. Tuning is possible not only for the low-frequency bands but also for high-frequency bands.

Further, since the air intake duct is essentially disposed close to the fan shroud, the air intake passage can be favorably made short.

In addition, since a portion of the shroud body 103 is jointly used as the resonator 102, the manufacturing cost becomes lower than the resonator 102 which is conventionally fabricated as a separate piece. The communicating pipe 104 and a portion of the air intake duct (primary-side air intake) can be integrally molded with the hollow vessel 101, and, when so done, the manufacturing cost can be further lowered. The number of components decreases, and inventory control is facilitated.

It should be noted that the invention is not limited to the disclosure of the foregoing embodiment, and various modifications are possible within the scope of the invention depending on the object and applications. The shapes, sizes, the number, the material, and the like of the hollow vessel 101, the fan shroud body 103, the communicating pipe 104, and the like may be appropriately selected in accordance with the application. Although in the embodiment a description has been given of only the hollow chamber S which is partitioned and formed into one or two chambers, it goes without saying that the hollow vessel 101 partitioned and formed into a greater number of chambers may be used as the resonator 102, and the hollow vessel 101 may be formed as the shroud body 103.

As described above, the resonator-integrated fan shroud and the resonator-integrated fan shroud with an air intake duct in accordance with the invention make it possible to install the resonator contributing to the reduction of noise in a low-frequency band without taking up much space for installing the resonator and without making the intake passages long, and are extremely useful for the engine compartment for which stepped-up efforts are being made for making the space compact.

What is claimed is:

1. A resonator-integrated fan shroud for a vehicle, comprising a hollow vessel defining a hollow chamber used as a resonator, wherein the hollow vessel is arranged to form a fan shroud body for said vehicle.

2. The resonator-integrated fan shroud according to claim 1, wherein the hollow chamber has an opening connected to an air intake duct.

3. A resonator-integrated fan shroud comprising a hollow vessel defining a hollow chamber used as a resonator, wherein the hollow vessel is arranged to form a fan shroud body, and wherein the hollow chamber is partitioned into a plurality of hollow chambers.

4. A resonator-integrated fan shroud comprising:

a hollow vessel defining a hollow chamber used as a resonator, wherein the hollow vessel is arranged to form a fan shroud body; and a communicating pipe to be connected to an air intake duct, the communicating pipe integrally formed with the hollow vessel.

5. A resonator-integrated fan shroud comprising a hollow vessel defining a hollow chamber used as a resonator, wherein the hollow vessel is arranged to form a fan shroud body, and wherein a drain hole is formed in a bottom portion and/or a lower side portion of the hollow vessel.

6. A resonator-integrated fan shroud comprising:

a hollow vessel defining a hollow chamber used as a resonator, wherein the hollow vessel is arranged to form a fan shroud body;

a communicating pipe integrally connected to the hollow vessel; and an air intake duct integrally connected to the communication pipe.

7. The resonator-integrated fan shroud according to claim 6 wherein a drain hole is formed in a bottom portion and/or a lower side portion of the hollow vessel.

8. The resonator-integrated fan shroud according to claim 7 wherein the hollow vessel is molded by blow molding.

9. The resonator-integrated fan shroud according to claim 8 wherein the hollow chamber is partitioned into a plurality of hollow chambers.

10. A resonator-integrated fan shroud for a vehicle, comprising:

a fan shroud body; and a cover member formed in a vessel shape and having an opening in one side, the cover member joined to and integrated with the fan shroud body to form the opening of the cover member and to form a hollow chamber by the cover member and the fan shroud body, wherein the hollow chamber is used as a resonator for said vehicle.

11. The resonator-integrated fan shroud according to claim 10, wherein the opening is connected to an air intake duct.

12. A resonator-integrated fan shroud comprising a fan shroud body;

a cover member formed in a vessel shape and having an opening in one side, the cover member joined to and integrated with the fan shroud body to form the opening of the cover member and to form a hollow chamber by the cover member and the fan shroud body, wherein the hollow chamber is used as a resonator for said vehicle; and a communicating pipe to be connected to an air intake duct, the communication pipe integrally formed with the hollow chamber.

* * * * *